United States Patent [19]

D'Souza

[11] 3,986,987

[45] Oct. 19, 1976

[54] LIGHT-DENSITY, LOW PHOSPHATE, PUFFED BORAX-CONTAINING DETERGENT COMPOSITIONS

[75] Inventor: Godfrey B. D'Souza, Etobicoke, Canada

[73] Assignee: Canada Packers Limited, Canada

[22] Filed: May 15, 1974

[21] Appl. No.: 470,308

[52] U.S. Cl. ..... 252/527; 252/135; 252/528; 252/531; 252/535; 252/539

[51] Int. Cl.[2] ..... C11D 3/065; C11D 11/00

[58] Field of Search ..... 252/135, 531, 535, 536, 252/539, 527; 423/279; 264/117; 427/213, 220

[56] References Cited

UNITED STATES PATENTS

| | | | |
|---|---|---|---|
| 2,623,856 | 12/1952 | Sanders | 252/135 |
| 3,356,613 | 5/1967 | Gedge | 252/527 |
| 3,533,942 | 10/1970 | Rhees et al. | 252/8.8 |
| 3,538,005 | 11/1970 | Weinstein et al. | 252/99 |
| 3,562,171 | 2/1971 | Guida | 252/186 |
| 3,574,119 | 4/1971 | Maruta et al. | 252/99 |
| 3,671,439 | 6/1972 | Corey et al. | 252/99 |
| 3,838,072 | 9/1974 | Smith et al. | 252/540 |
| 3,882,032 | 5/1975 | Gibbons | 252/99 |

FOREIGN PATENTS OR APPLICATIONS 586,622 11/1959 Canada

OTHER PUBLICATIONS

Rhees, "Puffed Borax," *Soap & Chemical Specialties*, Jan. 1966, pp. 59–61 and 118–120.

*Primary Examiner*—P.E. Willis, Jr.
*Attorney, Agent, or Firm*—Bacon & Thomas

[57] ABSTRACT

Low phosphate, light density, laundry detergent powder compositions, comprising an agglomerated mixture of expanded borax of bulk density of approximately 12 to 20 pounds per cubic foot as a carrier, additional builders, other adjuvants and organic liquid surfactants, such detergent compositions being produced by an economical cold spray-mix process under controlled and relatively anhydrous conditions. The weight percent of expanded borax of low bulk density is about 10% to 80%, preferably about 15% to 35%, and the weight percent of the organic liquid surfactant is 5% to 25%, typically 13% to 18%, of the detergent powder product. The phosphate content of the composition is not more than 5% based on $P_2O_5$.

13 Claims, No Drawings

LIGHT-DENSITY, LOW PHOSPHATE, PUFFED BORAX-CONTAINING DETERGENT COMPOSITIONS

This invention relates to laundry detergent powders produced by dry, cold, spray-mix agglomeration of expanded borax, additional builder salts, and other adjuvants, with water soluble organic liquid surfactants. The purpose of this invention is to produce effective low density, low phosphate and nitrilotriacetate containing laundry detergent powders of acceptable appearance and physical properties by a process that obviates the high capital and operating expense of hot spray-drying towers.

Conventionally, laundry detergent powders are produced by spraying a premixed aqueous slurry of builders, surfactants and adjuvants in hot, spray-drying towers to yield dry, free-flowing, non-caking, light-density beads (330 to 400 grams/liter) of desired particle size. One disadvantage of a hot spray-drying operation is the high investment cost and high operating cost of a spray tower caused by high thermal energy requirement and low tower drying efficiency. Another disadvantage is the preclusion of heat sensitive surfactants, amine oxides and ingredients such as sodium perborate. Another disadvantage is the limitation on use of sodium silicates which are effective builders, because of decomposition within the towers to $SiO_2$, and the production of fines and dust within the tower. All this necessitates frequently a sieving operation to remove fines and dust followed by post blending to incorporate the above mentioned heat sensitive materials.

An alternative process, disclosed in German Pat. No. 1,197,064, which overcomes many of these disadvantages, involves spraying a relatively anhydrous, cold mixture of surfactants onto a moving bed of builders and adjuvants in a rotating double conical mixer. In this case the bulk density, solubility and particle size of the product are dependent on the corresponding properties of the builder salts used in the formula. Up to the present time, the spray mix process as defined above has been successful in Europe due to the use of a large percentage, 30–50% by weight, of relatively low density, spray-dried sodium tripolyphosphate (150–200 grams/liter) as the spray bed.

For reasons of ecology it is desirable to restrict the use of phosphates in laundry detergents. Hitherto it has not been possible to produce a light density, 320–400 grams/liter, powder using a spray-mix process, in the absence of substantial percentages of low density sodium tripolyphosphate, due to the high bulk densities (900–1000 grams/liter) of the other available builders.

It has been disclosed in U.S. Pat. No. 2,623,856 that detergent compositions may be prepared by mixing liquid surfactants with borax either before or after dehydration of the borax to product beads. The borax beads in this instance were of very low density (0.1 gram per cubic centimeter) indicating that a major proportion of the water of crystallization was removed and it has been applicants experience that borax beads of such characteristics are undesirably fragile and lacking in solubility. A similar process is disclosed in U.S. Pat. No. 2,673,841. Here again the borax beads used were substantially anhydrous, i.e., over 95% of the water having been removed.

It has now been found that by the incorporation of a sufficient amount of expanded borax of certain critical specifications in the detergent builder mixture bed, and by spraying thereon, the specified liquid surfactants in a rotary spray mixer, dry, free-flowing light-density, powders, having less than about 5% $P_2O_5$, can be produced at significantly lower capital and operating costs than that of the slurried, hot, spraydrying operation. Detergent products of this type having a bulk density of, for example, 300 to 600 grams/liter may be produced. Without the use of puffed or expanded borax in the cold, spray-mixing process, the production of effective light-density, low-phosphate powders of acceptable free-flow and particle-size characteristics, is not possible.

The expanded borax used in this invention is produced by rapidly heating moving particles of sodium tetraborate pentahydrate under controlled conditions of temperature, mass flow rate, residence time and particle size of feed stock, to obtain uniformly expanded hollow borax particles of a critical bulk density. The expansion occurs due to the rapid internal release of water vapor from part of the 5 moles of water of crystallization leaving approximately 3 to 3.6 moles of water in the product. The process may be carried out in the specially designed, electrically heated, rotary drier as described in copending U.S. patent application Ser. No. 470,295 filed on the same date herewith now U.S. Pat. No. 3,944,651. Alternatively, a direct heat oil or gas fired flash drier, with or without a fluidized bed system, may be used.

Expanded borax suitable for the purposes of this invention has a bulk density of about 12 lbs/cubic foot to 20 lbs/cubic foot (about 190 to 320 grams/liter) with an optimum density of about 12 lbs/cubic foot and a particle size distribution as follows:

| | |
|---|---|
| above 830 $\mu$ | 5% |
| 830 – 415 $\mu$ | 68% |
| 415 – 250 $\mu$ | 23% |
| 250– 177 $\mu$ | 4% |

It has been found that borax beads with a bulk density less than about 12 lbs/cubic foot have inadequate wall strength when subjected to the attrition of the spray mix operation, production, transit and storage of the detergent powder. Beads of bulk density ranging from about 12 to 20 lbs/cubic foot and containing from about 3 to 3.6 moles of water of crystallization can be usefully employed in the production of detergent powders of a range of acceptable bulk density, particle size and free flow characteristics.

The amount of expanded borax of the specified bulk density used in the composition of the invention may range from about 10 to 80% by weight, and typically from 15 to 35% by weight, based on the total weight of the composition.

The organic liquid surfactants that can be used for the purpose of this invention are one or more members of the groups of the nonionic, anionic, amphoteric or zwitterionic types, alone, or in combination. These are used in an amount of from about 5 to 25%, typically from about 13% to 18%, based on the total weight of the composition.

Nonionic liquid detergents include those compounds containing an organic hydrophobic group and an organic solubilizing group, which is obtained by reacting a hydrophilic group like hydroxyl, carboxyl, amino or amido with an alkylene oxide such as ethylene oxide, or its polyhydration product. Examples intended for use are:

1. Alkyl polyglycol ethers of formula $R—O—(CH_2—CH_2—O)_nH$ where $R=C_{10}H_{21}$ to $C_{18}H_{37}$, typically $C_{12}H_{25}$, and $n=3$ to 15, preferably 10.

2. Alkylphenyl polyglycol ethers of formula

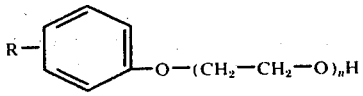

where $R=C_6H_{13}$ to $C_{12}H_{25}$, straight or branched chain, typically $C_9H_{19}$ and $n=3$ to 15, preferably 10.

3. Acyl alkylolamides of the formula $R—CO—NH—CH_2—CH_2—OH$ and

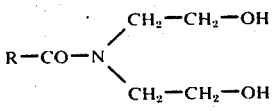

where $R=C_{11}H_{23}$ to $C_{17}H_{35}$

4. Alkylene oxide block copolymers of the structure

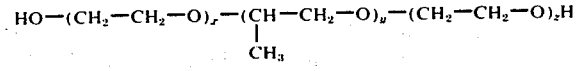

where y=15 to 40, preferably 30, and $(CH_2—CH_2—O)x+z$ is 20 to 90% by weight of the total compound, typically 50%. The molecular weight of this copolymer is preferably about 3500.

5. Amine oxides of the formula

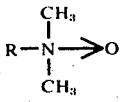

where $R=C_{12}H_{25}$ to $C_{16}H_{33}$, preferably $C_{12}H_{25}$.

Anionic detergents that can be used for the purpose of this invention are the alkali salts of acids containing an organic hydrophobic group and an anionic solubilizing group such as carboxylate, sulfonate or sulfate. The alkali metal, ammonium or alkylolammonium salts can be used but the sodium salts are preferred, on a cost performance basis. These detergents are charged to the rotary mixer either by the co-spraying and neutralization of anhydrous detergent acid with concentrated alkali by means of a suitable jet, or by spraying a highly concentrated aqueous slurry of the neutral salt on the moving powder bed. Examples of preferred anionic detergents used here are:

1. Alkylbenzene sulfonates of the formula

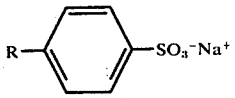

where R is substantially linear $C_{10}H_{21}$ to $C_{13}H_{27}$, preferably $C_{12}H_{25}$ and $C_{13}H_{27}$.

2. Alkyl carboxylates of the formula $R—COO^-Na^+$ where $R=C_{11}H_{23}$ to $C_{17}H_{35}$, preferably $C_{15}H_{31}$ and $C_{17}H_{35}$.

3. Alkyl sulfates of the formula $R—O—SO_3^-Na^+$ where $R=C_{12}H_{25}$ to $C_{18}H_{37}$, preferably $C_{12}H_{25}$ and $C_{16}H_{33}$.

4. Alkyl polyglycol ether sulfates of the formula $R—O—(CH_2—CH_2—O)_n—SO_3^-Na^+$ where $R=C_{12}H_{25}$ to $C_{18}H_{37}$ preferably $C_{12}H_{25}$, and $n=1$ to 6, preferably 3.

5. Alkene sulfonates, hydroxy alkane sulfonates and mixtures thereof, of structure $R—CH=CH—(CH_2)_x—SO_3^-Na^+$ where $R=C_{13}H_{27}$ to $C_{15}H_{31}$ and $x=0$ to 3, preferably 1, and

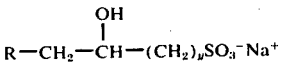

where $R=C_{12}H_{25}$ to $C_{14}H_{29}$ and $x=1$ to 2 preferably 2.

6. Alkane sulfonates of the formula $R—SO_3^-Na^+$ where $R=C_{15}H_{31}$ to $C_{18}H_{37}$.

7. Alkyl phenyl polyglycol ether sulfates of the structure

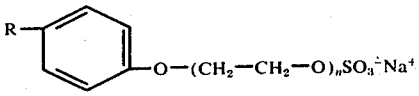

where $R=C_6H_{13}$ to $C_{12}H_{25}$, typically $C_9H_{19}$ and $n=1$ to 6, preferably 3.

8. Acyl monoglyceride sulfates of the structure

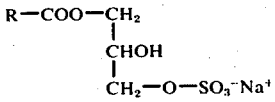

where $R=C_{11}H_{23}$ to $C_{17}H_{35}$, preferably $C_{11}H_{23}$.

9. Acyl isethionates of the formula

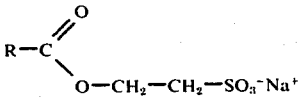

where $R=C_{11}H_{23}$ to $C_{17}H_{35}$, typically $C_{15}H_{31}$.

10. Acyl N methyl taurides of the structure

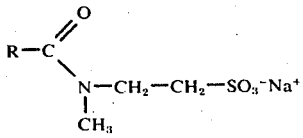

where $R=C_{17}H_{35}$.

Amphoteric detergents contain an organic hydrophobic group and both an anionic and cationic hydrophilic solubilizing group. These compounds are straight or branched chain aliphatic derivatives of secondary or tertiary amines or aliphatic derivatives of heterocyclic secondary or tertiary amines in which one aliphatic radical contains 8 to 18 carbon atoms, preferably 12, and at least one aliphatic radical contains an anionic hydrophilic group, e.g. carboxyl, sulfato or sulfo. These detergents are charged to the mixer in the manner indicated under anionic detergents. Examples of amphoteric detergents that can be used in this invention are:

1. N alkyl amino caroboxylates of the formula $R—N^+H—CH_2—CH_2—COO^-Na^+$ where $R=C_{10}H_{21}$ to $C_{20}H_{41}$, preferably $C_{12}H_{25}$.

2. N alkyl imino dicarboxylates of structure

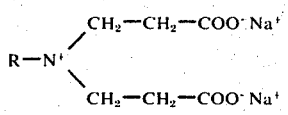

where $R=C_{10}H_{21}$ to $C_{20}H_{41}$ preferably $C_{12}H_{25}$

3. N alkyl betaines of the structure

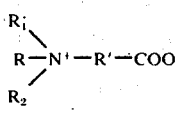

where R is $C_{10}H_{21}$ to $C_{20}H_{41}$ preferably $C_{12}H_{25}$, R′ is an alkylene radical eg. $C_2H_4$ and $R_1$ and $R_2$ are lower alkyl substitutents eg. $CH_3$ or $C_2H_5$.

Zwitterionic liquid detergents that can be used for the purpose of this invention are derivatives of aliphatic quaternary ammonium compounds in which the aliphatic radical may be straight chain or branched chain and in which one of the aliphatic substituents contains 8 to 18 carbon atoms, preferably 16, and at least one aliphatic radical contains an anionic hydrophilic group such as carboxy, sulfato or sulfo and in which the cationic atom may be part of a hetero cyclic ring. These detergents are charged to the mixer in the manner indicated under anionic detergents. These compounds are typified by the formula

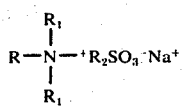

where $R=C_{16}H_{33}$, $R_1=CH_3$ and $R_2=C_3H_6$ or $C_3H_5OH$

Other builder salts that can be used in addition to the expanded borax for the purpose of this invention are:

1. One or more water soluble anhydrous or partially hydrated salts of the groups consisting of alkali metal carbonates, bicarbonates, sesquicarbonates, polyphosphates, phosphates, sulfates, perborates and silicates. Specific examples of these salts are $Na_2CO_3$, $NaHCO_3$, $NaBO_3$, $Na_3PO_4$, $Na_6P_6O_{18}$, $Na_5P_3O_{10}$, $Na_2SO_4$ and $Na_2O$, $x(SiO_2)$ where $x=1$ to 3.8, preferably 1.6 to 2.2. Combinations of sodium tripolyphosphate and sodium nitrilotriacetate may be employed in the composition of this invention, but where such combination is employed it is preferably limited to no more than 90%, preferably no more than 80% by weight of organic detergent used in the formula.

2. One or more organic builder salts consisting of water soluble amino polycarboxylates, for example $(Na^+{}^-OOCH_2C)_2—N—CH_2—CH_2—N—(CH_2—COO^-Na^+)_2$ and

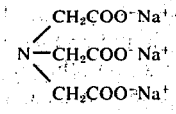

3. One or more organic builder salts consisting of water soluble polybasic hydroxy acids such as

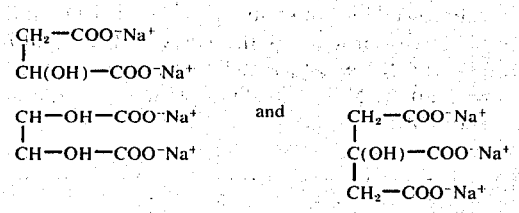

In addition to the aforementioned components of the laundry powder formula, the following adjuvants may be used for the purpose of this invention.

1. Optical brighteners, in quantity ranging from 0.1% to 0.5% of the detergent formula, by weight, of one or more compounds of the following classes.

a. Condensation products of 4,4′-diaminostilbene-2,2′-disulfonic acid and cyanuric chloride with amines such as aniline, diethanolamine, monoethanolamine or morpholine eg. Tinopal 5 BMC, Tinopal AMS, Tinopal DMS, Tinopal UNPA.

b. Bleach stable triazole derivatives of stilbene eg. Tinopal RBS.

c. Benzoxazolyl-styryl derivatives and 1,4 bis styryl benzol derivatives.

d. Methine or oxycyanin fabric brighteners for synthetic fibers such as polyamides and polyacrylonitriles.

2. Antiredeposition agents such as cellulose ethers eg. sodiumcarboxymethyl cellulose in amounts of 1% to 5%, typically 2% by weight of the detergent powder. Alternatively, like quantity of polyvinyl alcohol may be used instead.

3. Corrosion inhibitors and stabilizers such as sodium or magnesium silicate in amounts of 0.1 to 0.5% by weight in the formula.

4. Perfume in amounts of 0.2% to 1.0% by weight in the formula.

5. Dyestuffs, in required concentrations, as desired.

The following representative examples are illustrative of this invention. In the examples, individual components are indicated in percentage by weight.

EXAMPLE I

Low-foaming, heavy-duty laundry detergent powder.

| | |
|---|---|
| Dodecyl alcohol polyglycolether 10E. 0 (85%) | 13.0% |
| Coconut-tallow fatty acid, mono and diethanolamide blend | 2.0% |
| Expanded borax (192 grams/liter) | 15.0% |
| Sodium tetraborate pentahydrate | 10.0% |
| Sodium carbonate anhydrous | 21.5% |
| Sodium Sesquicarbonate $2H_2O$ | 19.35% |
| Sodium nitrilotriacetate $H_2O$ | 4.0% |
| Sodium tripolyphosphate | 5.0% |
| Sodium metasilicate anhydrous | 7.5% |
| Sodium carboxymethylcellulose | 2.0% |
| Tinopal RBS 200 | 0.1% |
| Tinopal DMS > (optical brighteners) | 0.3% |
| Perfume No. 7177 | 0.25% |
| TOTAL | 100.00% |

A premix of the optical brighteners with the sodium carboxymethylcellulose is prepared. The perfume is then dissolved in the liquid surfactant, heated to 98.6° F. The expanded borax and other solids are charged to a rotary spray mixer of 600 kgs capacity and are mixed for 5 minutes, followed by addition of the optical brightener premix, and by further mixing for 5 minutes. The surfactant liquid containing the perfume is then sprayed on to the moving powder over a period of 5 minutes followed by a postmixing period of 10 minutes, after which the product is discharged. The resulting detergent powder is dry, free-flowing and has a bulk density of about 500 grams/liter with a particle size distribution of

| | |
|---|---|
| 1680 μ – 595 μ | 58.3% |
| 595 μ – 149 μ | 40.4% |
| <149 μ | 1.3% |

EXAMPLE 2

High foaming heavy duty laundry detergent powder.

| | |
|---|---|
| Nonyl phenol polyglycol ether 10 E.O. | 12.0% |
| Dodecyl benzene sulfonic acid (M.W. 320) | 7.5% |
| Sodium carbonate anhydrous (soda ash) | 23.1% |
| Expanded borax (192 grams/liter) | 35.0% |
| Sodium nitrilotriacetate $H_2O$ | 6.0% |
| Sodium tripolyphosphate anhydrous | 5.0% |
| Sodium metasilicate anhydrous | 4.5% |
| Sodium disilicate | 3.0% |
| Sodium carboxymethyl cellulose | 3.0% |
| Tinopal RBS 200 | 0.1% |
| Tinopal DMS | 0.3% |
| Perfume No. 7177 | 0.5% |
| TOTAL | 100.00% |

A preblend of the brighteners with sodium carboxymethyl cellulose is prepared. The perfume is dissolved in the nonionic surfactant. The soda ash is charged to the rotary spray mixer and sprayed first with liquid alkylbenzene sulfonic acid at 37° C over a period of 5 minutes followed by an aging period of 10 minutes, while maintaining rotation. The other builders and expanded borax are then charged, followed by the optical brightener mix, and mixed for a further period of 10 minutes. The moving powder bed is then sprayed with the nonionic surfactant at 37° C over a period of 5 minutes, followed by a post mixing period of 10 minutes. The product is then discharged. It has a bulk density of 390 grams/liter and a particle size distribution as follows:

| | |
|---|---|
| 1680 μ – 595 μ | 90.3% |
| 595 μ – 149 μ | 7.3% |
| <149 μ | 2.4% |

The product has acceptable free-flowing and noncaking characteristics.

Several formulas, of which the above examples are representative were evaluated for washing efficiency, whiteness and fabric handle in Tergotometer and simulated home laundry multiple wash tests, using a municipal water of 122 ppm hardness, 120° F wash temperature, and US Testing and Test fabric soiled cloths, in combination with AHAM standard wash loads. The performances of these detergents were found to be equivalent to that of leading brands of spray-dried household detergents.

The embodiments of the invention in which an exclusive property or privilege is claimed are defined as follows:

1. A light-density, low-phosphate, laundry detergent composition consisting essentially of a cold spray-mix agglomeration of puffed borax with at least one other normally solid builder salt and at least one organic liquid surfactant; said puffed borax having a bulk density of about 12 pounds to about 20 pounds per cubic foot and being present in the composition in an amount of about 10% to 80% by weight; said at least one other normally solid builder salt being selected from the group consisting of water soluble, alkali metal carbonates, bicarbonates, sesquicarbonates, polyphosphates, phosphates, sulfates, silicates, amino polycarboxylates, hydroxy polycarboxylates and combinations thereof, with the provision that the phosphate content of the composition is less than 5% by weight based on $P_2O_5$; and said at least one organic liquid surfactant being selected from the group consisting of non-ionic, anionic, amphoteric and zwitterion compounds and combinations thereof and being present in an amount of from about 5 to 25 weight percent.

2. The detergent powder of claim 1 wherein the weight percent of puffed borax is about 15% – 35%, and the weight percent of surfactant is about 13% – 20%.

3. The detergent powder of claim 1 having a bulk density between about 300 to 600 grams/liter.

4. The detergent powder of claim 1 comprising an agglomerate of puffed borax of a bulk density of about 12 lbs/cubic foot and an organic liquid surfactant selected from the group consisting of nonionic, anionic, amphoteric, and zwitterionic compounds alone or in combination.

5. The detergent powder of claim 4 wherein the puffed borax has a particle size distribution of about:

| | |
|---|---|
| above 830 μ | 5% |
| 830 – 415 μ | 68% |
| 415 – 250 μ | 23% |
| 250 – 177 μ | 4% |

6. The detergent powder of claim 1 wherein the builder salts include a combination of sodium tripolyphosphate and sodium nitrilotriacetate in an amount of less than 90% of the weight of the organic liquid surfactants used.

7. The detergent composition of claim 1 wherein an amine oxide of the formula:

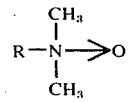

Where $R{=}C_{12}H_{25}$ to $C_{16}H_{33}$, is present as a non-ionic liquid surfactant.

8. The detergent composition of claim 1 which includes a water soluble anhydrous or partially hydrated alkali metal silicate as a builder.

9. The detergent powder of claim 1 wherein the puffed borax contains approximately 3 to 3.6 moles of water of crystallization.

10. A process for preparing a low density, low phosphate laundry detergent composition in the form of agglomerated granules, beads or powders consisting essentially of, spraying at least one organic liquid surfactant selected from the group consisting of nonionic, anionic, amphoteric, and zwitterionic compounds, alone or in combination, in a dry, cold atmosphere onto a powder bed containing puffed borax and at least one other normally solid builder salt to provide from about 5 to 25 weight percent of said surfactant in said composition; said puffed borax having a bulk density of about 12 pounds to about 20 pounds per cubic foot and being present in the composition in a amount of about 10% to 80% by weight, said at least one other normally solid builder salt being selected from the group consisting of water soluble, alkali metal carbonates, bicarbonates, sesquicarbonates, polyphosphates, phosphates, sulfates, silicates, amino polycarboxylates, hydroxy polycarboxylates and combinations thereof, with the proviso that the phosphate content of the composition is less tha 5% by weight based on $P_2O_5$ .

11. The process of claim 10 wherein the puffed borax in the powder bed is sufficient to provide from about 15% to 35% by weight based on the total weight of the composition.

12. The process of claim 10 wherein the puffed borax is present in an amount sufficient to provide from 15 – 35% by weight and the organic liquid surfactant is present in an amount sufficient to provide from 5% – 25% by weight based on the total weight of the composition.

13. The process of claim 12 wherein the puffed borax has a particle size of approximately:

| | |
|---|---|
| above 830 μ | 5% |
| 830 – 415 μ | 68% |
| 415 – 250 μ | 23% |
| 250 – 177 μ | 4%. |

* * * * *